US005724636A

United States Patent [19]

Tombs et al.

[11] Patent Number: 5,724,636

[45] Date of Patent: Mar. 3, 1998

[54] METHOD AND APPARATUS FOR TRANSFERRING A TONER IMAGE TO A RECEIVER SHEET USING AN ELECTRICAL BIAS

[75] Inventors: Thomas N. Tombs; John W. May, both of Rochester; Bruce R. Benwood, Churchville, all of N.Y.

[73] Assignee: Eastman Kodak Company, Rochester, N.Y.

[21] Appl. No.: 745,728

[22] Filed: Nov. 12, 1996

[51] Int. Cl.[6] ..... G03G 15/16

[52] U.S. Cl. ..... 399/313; 399/314

[58] Field of Search ..... 399/66, 313, 314, 399/297, 298, 296, 310, 311, 315, 316, 318

[56] References Cited

U.S. PATENT DOCUMENTS

| | | | |
|---|---|---|---|
| 3,781,105 | 12/1973 | Meager . | |
| 3,830,589 | 8/1974 | Allen | 399/314 |
| 3,832,053 | 8/1974 | Goel et al. | 399/314 |
| 3,860,857 | 1/1975 | Nakmiki et al. | 399/314 X |
| 4,098,227 | 7/1978 | Thompson | 399/314 X |
| 4,338,017 | 7/1982 | Nishikawa . | |
| 4,401,383 | 8/1983 | Suzuki et al. . | |
| 5,187,526 | 2/1993 | Zaretsky . | |
| 5,189,479 | 2/1993 | Matsuda et al. . | |
| 5,276,490 | 1/1994 | Bartholmae et al. . | |
| 5,287,152 | 2/1994 | Oka et al. . | |
| 5,303,013 | 4/1994 | Koike et al. . | |
| 5,321,477 | 6/1994 | Nagata et al. . | |
| 5,428,429 | 6/1995 | Fletcher | 399/314 X |
| 5,442,429 | 8/1995 | Bartholmae et al. . | |
| 5,459,560 | 10/1995 | Bartholmae et al. . | |
| 5,461,461 | 10/1995 | Harasawa et al. . | |

OTHER PUBLICATIONS

R.M. Schaffert, Electrophotography, Focal Press N.Y. 1975, pp. 514–518.

*Primary Examiner*—Shuk Lee

*Attorney, Agent, or Firm*—Norman Rushefsky

[57] ABSTRACT

A method and apparatus for electrostatically transferring a toner image from a toner image bearing member to a receiver sheet is disclosed. A receiver sheet is moved within a nip defined between a transfer roller having a resistive outer layer and a toner image bearing member supporting a toner image. To provide for transfer, there is applied to the resistive layer a first contact voltage to establish a post-nip electrical voltage distribution to a post-nip region of the transfer roller that is immediately downstream of an in-nip region. The post-nip electrical bias is accomplished by having the first contact voltage be applied at first points on the outer layer of the transfer roller, the first points being within or proximate the post-nip region. There is also applied to the resistive layer a second contact voltage to establish a pre-nip electrical voltage distribution to a pre-nip region of the transfer roller immediately up-strean of the in-nip region. This pre-nip electrical voltage distribution is accomplished by having the contact voltage be applied at second points on the outer layer of the transfer roller, the second points being within or proximate the pre-nip region. Because of the resistivity of the outer layer, the pre-nip and post-nip voltage distributions establish an in-nip electrical field suitable for transfer of the toner image to a receiver sheet.

25 Claims, 4 Drawing Sheets

METHOD AND APPARATUS FOR TRANSFERRING A TONER IMAGE TO A RECEIVER SHEET USING AN ELECTRICAL BIAS

BACKGROUND OF THE INVENTION

This invention relates to electrostatography and more particularly to an improved method and apparatus for transferring a toner image to receiver sheets.

Ideally, in transferring a toner image from an image-beating member to a receiver sheet, the electrostatic transfer force on the toned image must be made as high as possible in the transfer nip. Increasing the applied electric field increases the electrostatic force. However, the electric field is limited by air breakdown (ionization) which occurs when the electric field exceeds the Paschen limit (see R. M. Schaffert, *Electrophotography*, Focal Press, New York (1975), pp. 514–518). While a small amount of ionization can be tolerated, excessive ionization causes image defects and reduces transfer efficiency.

Three distinct regions can be identified in the transfer region: pre-nip, in-nip, and post-nip (see FIG. 1). When using a conventional resistive transfer roller to transfer toner to a receiver the electric field in the air gaps and toner stacks increases as the image traverses the pre-nip and in-nip regions of the nip. In the post-nip region the electric field decreases as the image moves away from the nip. In the pre-nip region it is desirable to keep the magnitude of electric field low to prevent i) premature toner transfer across large air gaps, which blurs the image, and ii) pre-nip ionization, which causes image mottle and poor transfer efficiency. The electric field in the transfer nip (the in-nip region), however, must be larger than in the pre-nip region because this is where transfer of the toned image should occur. Ideally, the electric field in the transfer nip is made as large as possible without allowing significant ionization or pre-nip transfer. The electrical properties of the transfer roller must be carefully selected to maximize the electric field used for toner transfer and, at the same time, minimize the amount of ionization.

It is well known in the art to use a resistive transfer roller to optimize toner transfer from an imaging member to a final receiver (paper). Meager, U.S. Pat. No. 3,781,105 (1987) describes the use of a transfer roller for transferring toner images to a receiving sheet. This reference suggests the transfer roller have a blanket with a resistivity of $10^9$ to $10^{11}$ ohm-cm.

Bartholmae and Tompkins, U.S. Pat. No. 5,276,490 (1994) and Koike et al. U.S. Pat. No. 5,303,013 (1994) disclose the use of transfer rollers containing multiple parallel electrodes to aid paper handling and also to control the application of an electrical bias during the transfer of toner images.

Zaretsky, U.S. Pat. No. 5,187,526 (1993) points out that transfer can be improved by separately specifying the resistivity of an intermediate transfer roller and a second transfer roller, which form a nip for transfer to paper.

One difficulty encountered by the aforementioned techniques of utilizing transfer rollers is the limitation imposed by air breakdown (ionization) in the vicinity of the nip in which the toner is transferred to the receiver. Air breakdown degrades the transfer efficiency and image quality of toner images, especially multi-color images, by altering the quantity of charge on the toner particles. In practice, this problem is amplified because transfer rollers are typically doped with anti-stats or other conducting materials that are sensitive to fluctuations in temperature and relative humidity. There is a need to overcome these problems in order to improve the transfer to paper, especially for high quality color imaging and it is an object of the invention to provide a method and apparatus for transferring a toner image to a receiver sheet that overcomes or minimizes such problems.

SUMMARY OF THE INVENTION

The bias connection to a conventional transfer roller in a transfer station is typically made through the metal core of the transfer roller or from electrodes located beneath the outer layer. Contrarily, in accordance with a first aspect of the invention, a transfer station electrical contact voltage applicator is useful with a resistive transfer roller for transferring toner to a receiver sheet, such as paper, wherein a contact voltage is applied to the roller's surface in the post-nip region and a second contact voltage is applied to the roller's surface in the pre-nip region. The contact voltages are applied to the transfer roller's surface by a roller, blade, brush or by corona charging or combinations thereof. These contact voltages are applied to the resistive layer at points; i.e., locations, on the outer layer of the transfer roller rather than from points; i.e. locations, within the transfer roller.

In accordance with a second aspect of the invention, there is provided an apparatus for electrostatically transferring a toner image from a toner image-bearing member to a receiver sheet, the apparatus comprising a movable toner image bearing member supporting a toner image; a rotatable transfer roller located proximate the toner image bearing member so as to cooperate with the toner image bearing member to define a toner transfer nip for transferring the toner image to a receiver sheet moving within the nip, the transfer roller having a resistive outer layer; first means for applying a first contact voltage to the resistive layer at points in or proximate a post-nip region to establish a post-nip electrical voltage distribution in the post-nip region of the transfer roller that is immediately downstream of an in-nip region of the transfer roller; and second means for applying a second contact voltage to the resistive layer at points in or proximate a pre-nip region to establish a pre-nip electrical voltage distribution in the pre-nip region of the transfer roller that is immediately up-stream of the in-nip region.

In accordance with a third aspect of the invention there is provided a method for electrostatically transferring a toner image from a toner image-bearing member to a receiver sheet, the method comprising moving a receiver sheet within a nip defined between a transfer roller having a resistive outer layer and a toner image-bearing member supporting a toner image; applying a first contact voltage to the resistive layer at points in or proximate a post-nip region to establish a post-nip electrical voltage distribution in the post nip region of the transfer roller that is immediately downstream of an in-nip region; and applying a second contact voltage to the resistive layer at points in or proximate a pre-nip region to establish a pre-nip electrical voltage distribution in the pre-nip region of the transfer roller that is immediately upstream of the in-nip region.

The advantages of the method and apparatus of the invention are a reduction in pre-nip ionization and pre-nip transfer, which yields higher image quality and a more robust system. The invention also provides an apparatus which is simpler and more inexpensive to manufacture than a transfer apparatus that includes buried electrodes.

BRIEF DESCRIPTION OF THE DRAWINGS

In the detailed description of the preferred embodiments of the apparatus and method of the invention, reference is made to the accompanying drawings, in which.

DETAILED DESCRIPTION OF THE PREFERRED EMBODIMENTS

Because apparatus of the type described herein are well known, the present description will be directed in particular to elements forming part of or cooperating more directly with the present invention. The invention has particular utility with regard to copiers/duplicators/printers and in particular to transfer stations used therein.

Figure 1:
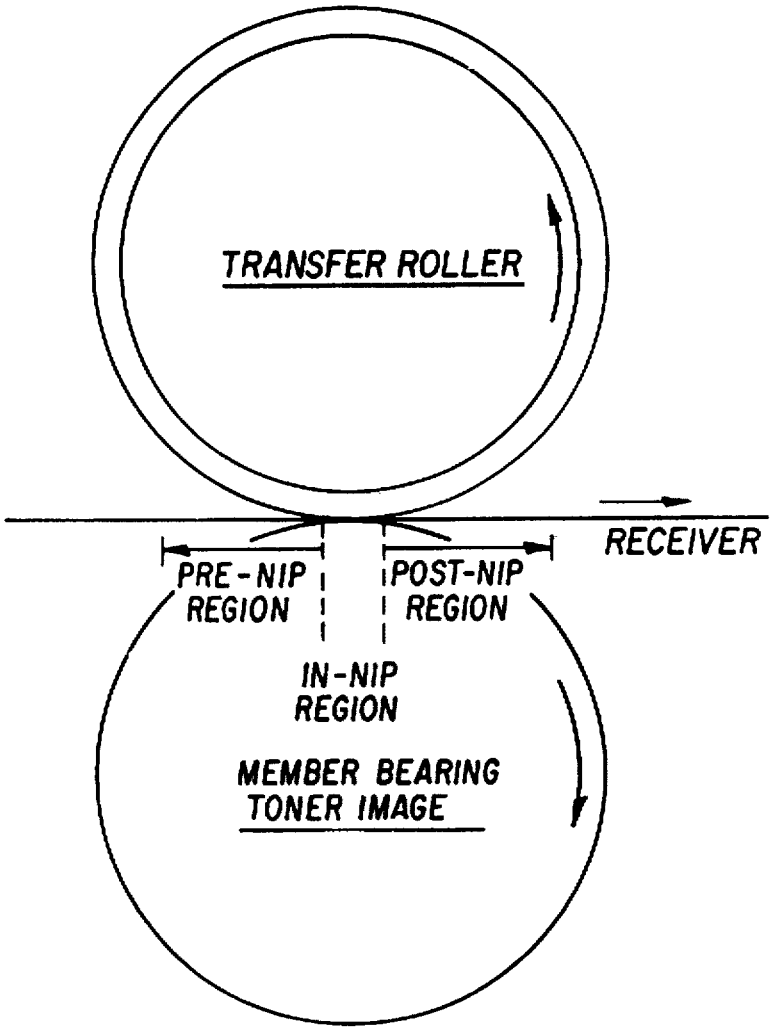
FIG. 1 is a schematic elevational view of a typical transfer station illustrating the location of the pre-nip, in-nip and post-nip regions of the transfer station.
Figure 2:
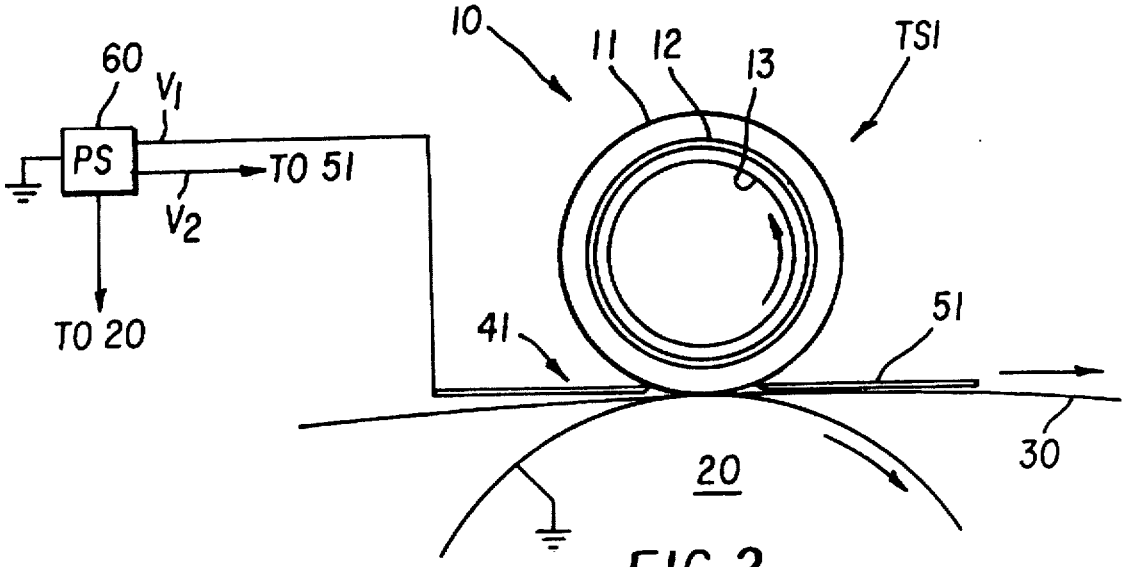
FIG. 2 is a schematic elevational view of a transfer station in accordance with one embodiment of the invention.

FIG. 2 shows a first embodiment of the invention. A transfer station apparatus, TS1, includes a cylindrical transfer roller 10 shown forming a nip with a toner image bearing member (TIBM) 20. In the following figures, the various layers of the transfer roller are not shown to scale; however, it is preferred as shown to have the transfer roller have a smaller diameter than the TIBM. Toner image bearing member 20 may be a primary imaging member of one or more layers, wherein a toner image is formed by photoconductive or electrographic means or by some other toner image generation means or process. Alternatively, TIBM 20 may be an intermediate transfer member wherein one or more toner images are formed on another primary imaging member and transferred to the TIBM for subsequent transfer to a receiver sheet. The TIBM 20 may support either a monocolor toner image or a multicolored image that is to be transferred to a receiver sheet 30 such as plain paper or a transparency sheet upon which the toner image is to be transferred and subsequently fused. Suitable means, not shown, may be provided for rotating the TIBM 20. Where TIBM 20 is a primary electrophotographic image forming member, it preferably includes a photoconductive layer. Although the TIBM 20 is shown as a roller, it may also be a web. The conductive electrode or layer (not shown) of the TIBM is grounded or biased to some voltage.

The transfer roller 10 has a resistive layer 11 on top of a supporting core 13. The core 13 is a rigid material, preferably hollow, and can be insulating or conducting. However, if the core is conductive, then an additional insulating layer 12 is required to electrically isolate the resistive layer 11 from the core 13. Insulating layer 12 should be sufficiently thick so that it does not electrically break down when the biases to the roller are applied. The biases are applied to the external surface of the transfer roller; i.e. to the outer surface of the resistive layer 11, by contacting the resistive layer's surface with conductive blades in both the pre-nip 41 and the post-nip regions 51. The blades are preferably metal or other conductive material and run the full length of the transfer roller's resistive layer surface so that the biases impressed by power source 60 is uniform across the full working length of the transfer roller which is at least as long as the cross-track direction of the sheet 30. The receiver sheet when entering the nip may be advanced by frictional engagement with the driven TIBM 20. The surface of the receiver sheet in engagement with the transfer roller may be used to drive the transfer roller.

The power supply 60 may be, for example, a variable voltage power supply that provides different respective voltage bias levels V1, V2 (relative to ground) to the blades 41, 51, respectively, to establish the respective pre-nip, in-nip and post-nip electrical potentials. The blades can also aid paper handling.

In using blades to provide the biasing by contacting the external surface of the transfer roller 10, it is important that the post-nip blade 51 not dig into the surface. Thus, the tip of the blade may be formed with a surface configuration such as a rounded or bulb-like configuration to avoid binding with or abrading of the roller 10. Other alternatives that inhibit binding may include control of angle of attack of blade with roller surface and/or use of spring biasing.

Figure 3:
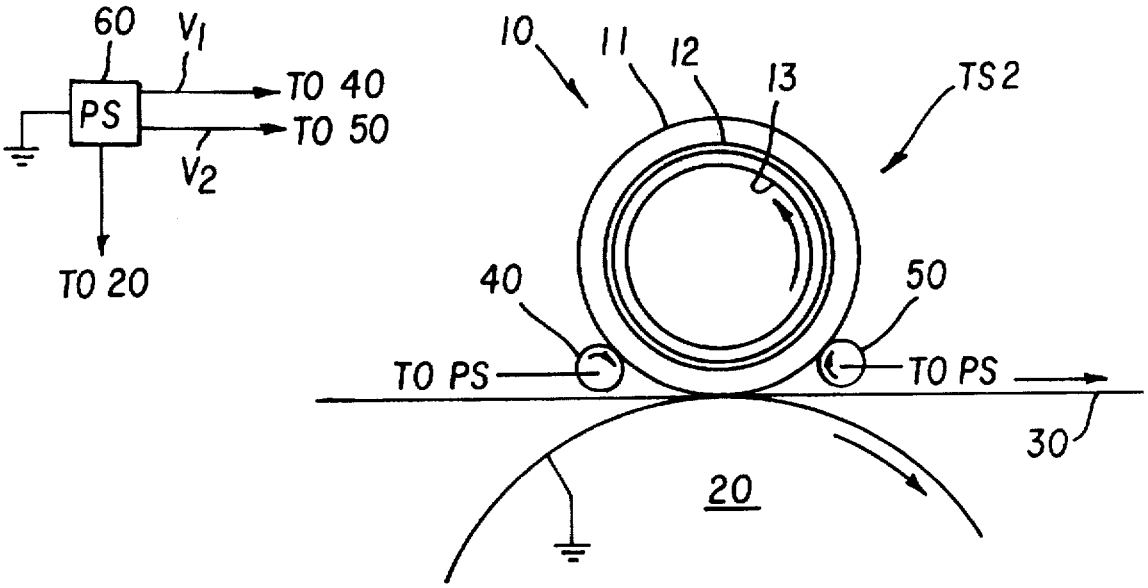
FIG. 3 is a schematic elevational view of a transfer station in accordance with a second embodiment of the invention.

FIG. 3 shows a second embodiment of the invention. In the transfer station, TS2 illustrated in FIG. 3, the only difference from the first embodiment is the means of applying the bias to the transfer roller surface. In this second embodiment where like numbers indicate similar structures to that of the first embodiment, rotating conductive biasing rollers, 40 and 50, are placed in contact with the resistive outer surface 11 of transfer roller 10 in the pre-nip and post-nip regions. The biasing rollers also extend for the full length of the resistive outer surface 11 of the transfer roller so that the bias is uniform across the full working length of the transfer roller. The biasing rollers 40, 50 are connected to the power supply PS so that biases V1, V2 are respectively impressed upon the biasing rollers and transferred to the resistive outer surface 11 of the transfer roller. The biasing rollers may be idler rollers that rotate through frictional engagement with the transfer roller. The biasing rollers through contact with the surface of resistive layer 11 establish the respective pre-nip, in-nip and post-nip electrical potentials.

Figure 4:
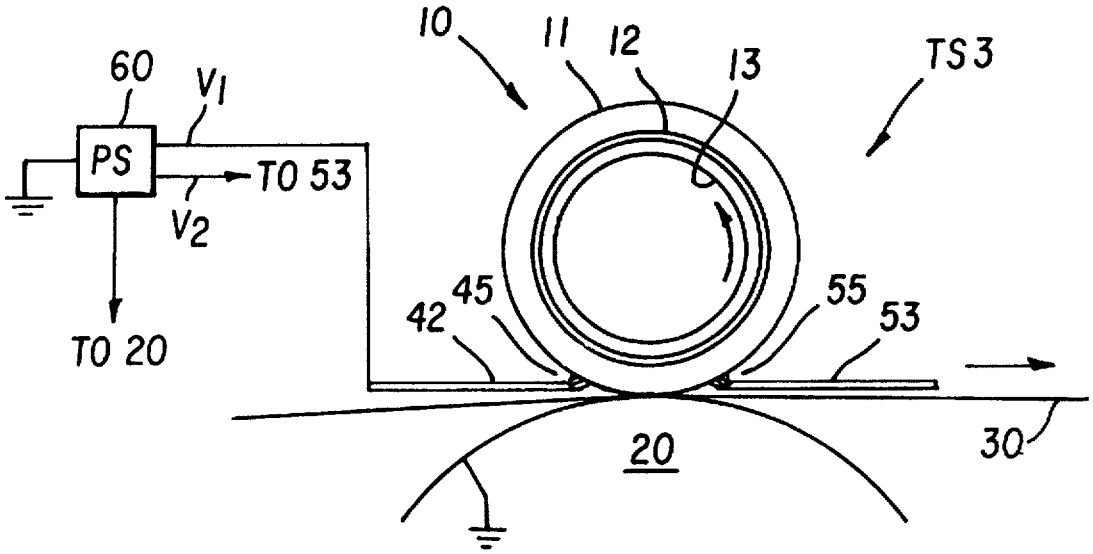
FIG. 4 is a schematic elevational view of a transfer station in accordance with a third embodiment of the invention.
Figure 6:
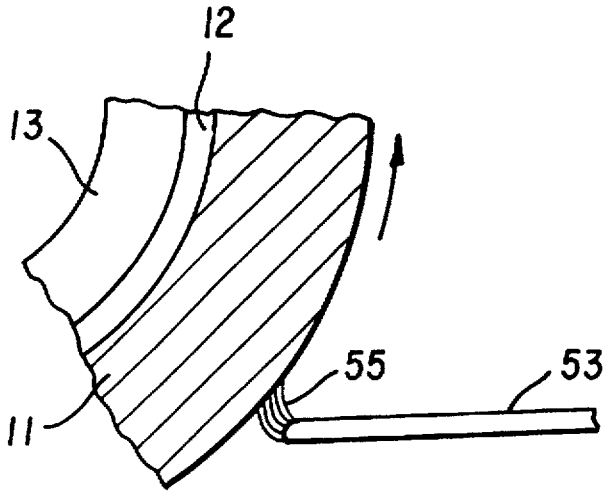
FIG. 6 is a schematic enlarged view of a portion of the transfer station of FIG. 4.

With reference now to FIG. 4, there is shown a third embodiment of a transfer station, TS3. Like numbers in this figure to that of FIG. 2 represent similar structures. The electrical biasing means for the transfer roller 10 are provided by electrical brushes 45, 55 which are provided respectively at the end of conductive blades 42, 53. The brushes are electrically connected to respective potentials of source 60 and engage the outer surface of resistive layer 11 of transfer roller 10 to thereby establish the respective pre-nip, in-nip and post-nip electrical potentials. The brushes also extend for the full length of the resistive surface 11 of the transfer roller so that the bias is uniform across the full working length of the transfer roller. Brushes have the advantage of flexibility and thus may tend to impose less wear upon the transfer roller (see FIG. 6).

Figure 5:
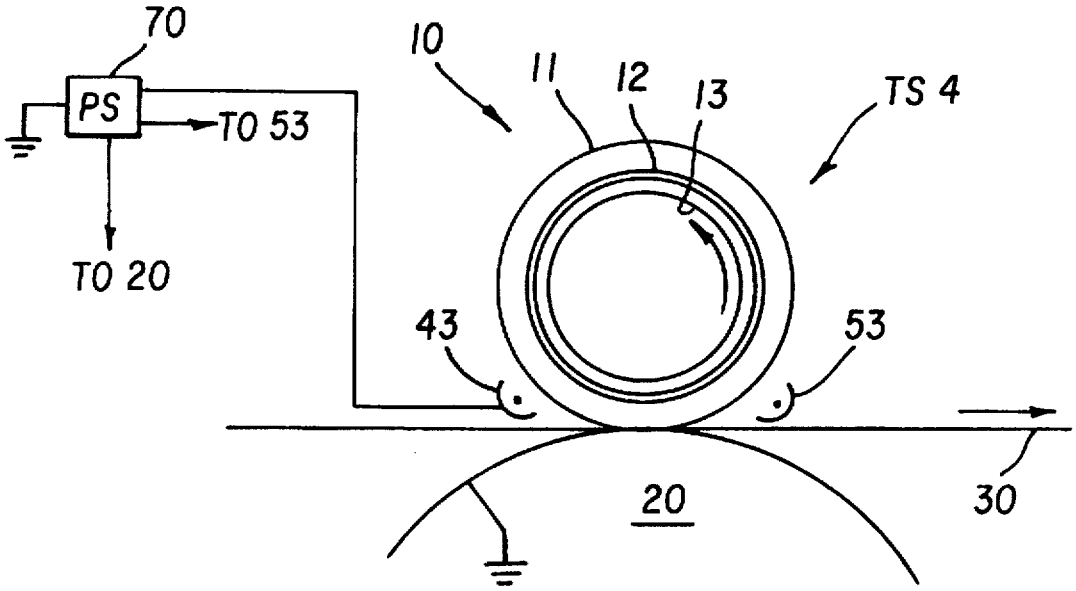
FIG. 5 is a schematic elevational view of a transfer station in accordance with a fourth embodiment of the invention.

With reference now to FIG. 5, there is shown a fourth embodiment of a transfer station, TS 4. Like numbers in this figure to that of FIG. 2 represent similar structures. The electrical biasing means for the transfer roller 10 are provided by two corona chargers 43, 53 which deposit respective corona currents at the pre-nip and post-nip regions to the surface of the transfer roller 10. The chargers 43, 53 may be either pin or wire corona chargers or other chargers known in the art, including gridded chargers AC and/or DC chargers, and extend for the full working length of the outer surface of resistive layer 11. The charge from the corona chargers deposited onto the resistive layer 11 establish the respective pre-nip, in-nip and post nip electrical potentials. A suitable corona charger power supply 70 applies respective voltages to the corona chargers to deliver the respective currents needed to establish these electrical potentials.

In all embodiments the bias is applied so as to create a voltage profile in the resistive layer 11 which creates a sufficient electric field in the in-nip region to urge transfer of toner to the receiver and at the same time produces a small electric field in the pre-nip region to minimize pre-nip transfer and pre-nip ionization. This is accomplished by applying a potential difference ($V_1$–$V_2$) between the pre-nip and post-nip biasing means. The potential applied to the contact voltage applicators in the pre-nip region is set so that the resulting electric field in the pre-nip region is small and, therefore, does not cause ionization or pre-nip transfer. The contact voltage applied in the pre-nip region may be ground. The potential applied to the biasing means in the post-nip region is set to create the transfer field in the in-nip region, thus the magnitude is generally large, 500 V to 4000 V, and the polarity is opposite to that of the toner. Alternatively, a constant current source can be used for a bias in the post-nip region.

The optimum resistivity of layer 11 on the transfer roller depends on several factors including, the process speed, the thickness of the blanket material, and whether direct or intermediate transfer is being performed. The preferable range for the resistivity of layer 11 is from about $10^7$ to about $10^{11}$ ohm-cm. Suitable materials for layer 11 may include polyurethanes doped with antistats. Preferably, layer 11 is a compliant layer and may be provided with an optional overcoat (not shown) of suitable resistivity and having desirable release properties to aid cleaning.

The contact voltage applicators described above may require cleaning periodically and suitable means may be provided for this. In addition, means may be provided for precluding or lowering the likelihood of contamination of these applicators.

Thus, there has been shown a transfer station that may be implemented by various embodiments in which certain specific embodiments are described herein. The embodiments may have elements mixed so that, for example, a roller may be used at the post-nip position while a blade or brush or corona charger is used at a pre-nip position to apply the contact voltages for post-nip and pre-nip, respectively. Mixing of the various elements may be desirable because of mechanical fit considerations; e.g., for example some elements such as brushes, blade and pin chargers may be able to be positioned closer to the respective region for applying their respective contact voltages. As used herein, a corona charger is broadly considered a means for applying a contact voltage even though the charger itself would not contact the transfer roller, but the charge deposited by the charger does.

Figure 7:
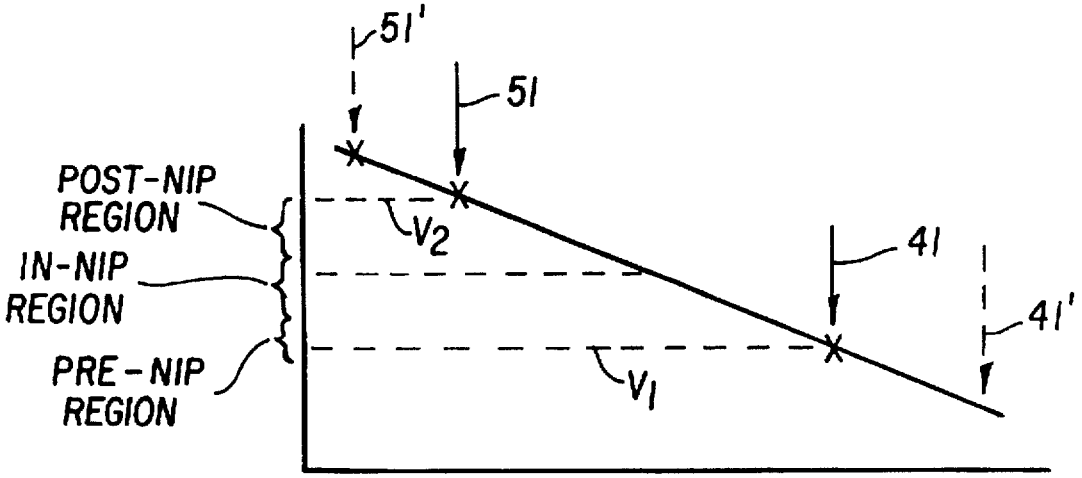
FIG. 7 is a diagram illustrating a relationship between applied contact voltages and voltage distributions in various pans of the transfer roller.

As may be seen in FIG. 7, the resistive outer layer may be one that is characterized by exhibiting a linear drop in voltage bias between contact voltage application points as shown (51, 41). As such, current flows from one contact point to the other and establishes a post-nip voltage distribution and a pre-nip voltage distribution and an in-nip voltage distribution that is a value intermediate that of the post-nip and pre-nip contact voltages. It may be seen in FIG. 7 that the post-nip region voltage distribution varies depending upon position from the position of application of the respective contact voltage. In this regard, it may be seen that the post-nip contact voltage may be applied at points considered outside the post-nip region such as indicated in phantom 51'. However, the further removed from the post-nip region, the higher the applied contact voltage to provide for the same biases in the various regions. A similar result may be seen if the pre-nip contact voltage is applied outside the pre-nip region except that the applied contact voltage 41' is lower than if applied within the pre-nip region. While a linear resistive layer characteristic is illustrated, the invention may also be used with resistive layers that exhibit non-linear resistive behavior.

Thus, in accordance with the invention, the points of application of a contact voltage may be in or proximate the respective region (pre-nip or post-nip) wherein "proximate" implies that the contact voltage has an affect to establish the appropriate bias within the respective region. The application of the contact voltages at or proximate the pre-nip and post-nip regions causes a transfer electrical field to be established in the in-nip region. This field varies with position within the nip and its maximum value is preferably about 40 volts per micrometer in the direction of the transfer. The various implementing embodiments feature a transfer roller having a resistive surface that is differentially biased by electrical sources applied externally; i.e., at points on the outer layer of the transfer roller, to the transfer roller's resistive layer so that the pre-nip, in-nip and post-nip regions of the transfer roller have different voltages suited for the transfer operation.

The invention has been described in detail with particular reference to a preferred embodiment thereof, but it will be understood that variations and modifications can be effected within the spirit and scope of the invention.

We claim:

1. A method for electrostatically transferring a toner image from a toner image bearing member to a receiver sheet, the method comprising:

moving a receiver sheet within a nip having an in-nip region defined between a transfer roller having a resistive outer layer and a toner image-bearing member supporting a toner image;

applying a first contact voltage to the resistive outer layer at first points in or proximate to a post-nip region to establish a post-nip electrical voltage distribution in the post nip region of the transfer roller that is immediately downstream with respect to the in-nip region of the transfer roller; and applying a second contact voltage to the resistive outer layer at second points in or proximate to a pre-nip region to establish a pre-nip electrical voltage distribution in the pre-nip region of the transfer roller that is immediately up-stream with respect to the in-nip region of the transfer roller.

2. The method of claim 1 wherein at least one of the first contact voltage and the second contact voltage is applied by an electrically conductive blade that respectively engages the resistive outer layer at the first or second points.

3. The method of claim 1 wherein at least one of the first contact voltage and the second contact voltage is applied by an electrically conductive roller that respectively engages the resistive outer layer at the first or second points.

4. The method of claim 1 wherein at least one of the first contact voltage and the second contact voltage is applied by an electrically conductive brush that respectively engages the resistive outer layer at the first or second points.

5. The method of claim 1 wherein at least one of the first contact voltage and the second contact voltage is applied by a corona charger that respectively deposits charge upon the resistive outer layer at the first or second points.

6. The method of claim 1 wherein resistivity of the resistive outer layer is between about $10^7$ and about $10^{11}$ ohm-cm.

7. The method of claim 2 wherein resistivity of the resistive outer layer is between about $10^7$ and about $10^{11}$ ohm-cm.

8. The method of claim 3 wherein resistivity of the resistive outer layer is between about $10^7$ and about $10^{11}$ ohm-cm.

9. The method of claim 4 wherein resistivity of the resistive outer layer is between about $10^7$ and about $10^{11}$ ohm-cm.

10. The method of claim 5 wherein resistivity of the resistive outer layer is between about $10^7$ and about $10^{11}$ ohm-cm.

11. The method of claim 1 wherein the toner image is a multicolored image.

12. The method of claim 1 wherein application of the first and second contact voltages cooperate to establish an in-nip electrical bias of the transfer roller.

13. The method of claim 12 wherein the first and second contact voltages are each applied across a full working length of the transfer roller.

14. An apparatus for electrostatically transferring a toner image from a toner image bearing member to a receiver sheet, the apparatus comprising:

a movable toner image bearing member supporting a toner image;

a rotatable transfer roller located proximate the toner image bearing member so as to cooperate with the toner image bearing member to define a toner transfer nip for transferring in an in-nip region the toner image to a receiver sheet moving within the nip, the transfer roller having a resistive outer layer;

first means for applying a first contact voltage to the resistive outer layer at first points in or proximate a post-nip region to establish a post-nip electrical voltage distribution in the post nip region of the transfer roller that is immediately downstream with respect to the in-nip region of the transfer roller, the first points being within or proximate the post-nip region; and second means for applying a second contact voltage to the resistive outer layer at second points in or proximate a pre-nip region to establish a pre-nip electrical voltage distribution in the pre-nip region of the transfer roller that is immediately up-stream with respect to the in-nip region of the transfer roller.

15. The apparatus of claim 14 wherein at least one of the first means and second means is an electrically conductive blade that respectively engages the resistive outer layer at the first or second points.

16. The apparatus of claim 14 wherein at least one of the first means and second means is an electrically conductive roller that respectively engages the resistive outer layer at the first or second points.

17. The apparatus of claim 14 wherein at least one of the first means and second means is an electrically conductive brush that respectively engages the resistive outer layer at the first or second points.

18. The apparatus of claim 14 wherein at least one of the first means and second means is a corona charger that respectively deposits charge upon the resistive outer layer at the first or second points.

19. The apparatus of claim 14 wherein resistivity of the resistive outer layer is between about $10^7$ and about $10^{11}$ ohm-cm.

20. The apparatus of claim 15 wherein resistivity of the resistive outer layer is between about $10^7$ and about $10^{11}$ ohm-cm.

21. The apparatus of claim 16 wherein resistivity of the resistive outer layer is between about $10^7$ and about $10^{11}$ ohm-cm.

22. The apparatus of claim 17 wherein resistivity of the resistive outer layer is between about $10^7$ and about $10^{11}$ ohm-cm.

23. The apparatus of claim 18 wherein resistivity of the resistive outer layer is between about $10^7$ and about $10^{11}$ ohm-cm.

24. For use in a transfer station that includes a transfer roller having a resistive outer layer and a toner image beating member that cooperate to form a nip into which a receiver sheet may be moved, contact voltage applicators for imparting a voltage distribution to a surface of the transfer roller, the voltage applicators comprising:

a first conductor that when electrically biased is adapted to apply a first contact voltage to the resistive outer layer across a full working length of the transfer roller to establish a post-nip voltage distribution; and a second conductor that when electrically biased is adapted to apply a second contact voltage to the resistive outer layer across a full working length of the transfer roller to establish a pre-nip voltage distribution.

25. An apparatus for electrostatically transferring a toner image from a toner image bearing member to a receiver sheet, the apparatus comprising:

a movable toner image bearing member supporting a toner image;

a rotatable transfer roller located proximate the toner image bearing member so as to cooperate with the toner image bearing member to define a toner transfer nip having an in-nip region for transferring the toner image to a receiver sheet moving within the nip, the transfer roller having a resistive outer layer;

a first external voltage applicator applying a first contact voltage bias to the resistive outer layer at points in or proximate a post-nip region of the transfer roller to establish a post-nip electrical voltage distribution to the post nip region of the transfer roller that is located immediately downstream with respect to the in-nip region of the transfer roller, the first points being within or proximate the post-nip region; and a second external voltage applicator applying to the resistive outer layer a second contact voltage bias to establish a pre-nip electrical voltage distribution to a pre-nip region of the transfer roller that is located immediately up-stream with respect to the in-nip region.

* * * * *